US008297485B2

(12) United States Patent
Schneider et al.

(10) Patent No.: US 8,297,485 B2
(45) Date of Patent: Oct. 30, 2012

(54) STAPLER

(75) Inventors: Thomas Schneider, Leonberg (DE); Ulrich Schneider, Stuttgart (DE); Kurt Leute, Blumberg (DE)

(73) Assignee: Esselte Leitz GmbH & Co KG, Stuttgart (DE)

( * ) Notice: Subject to any disclaimer, the term of this patent is extended or adjusted under 35 U.S.C. 154(b) by 124 days.

(21) Appl. No.: 12/736,091

(22) PCT Filed: Mar. 10, 2009

(86) PCT No.: PCT/EP2009/052758

§ 371 (c)(1),
(2), (4) Date: Sep. 23, 2010

(87) PCT Pub. No.: WO2009/112474

PCT Pub. Date: Sep. 17, 2009

(65) Prior Publication Data

US 2011/0011913 A1 Jan. 20, 2011

(30) Foreign Application Priority Data

Mar. 10, 2008 (DE) ..... 10 2008 013 355

(51) Int. Cl.
*B25C 5/02* (2006.01)

(52) U.S. Cl. ..... 227/120; 227/119; 227/132; 227/135; 227/136

(58) Field of Classification Search ..... 227/119, 227/120, 132, 135, 136
See application file for complete search history.

(56) References Cited

U.S. PATENT DOCUMENTS

| | | | | |
|---|---|---|---|---|
| 2,660,725 | A | 12/1953 | Curtiss | |
| 3,630,428 | A * | 12/1971 | Olney et al. | 227/128 |
| 4,520,956 | A | 6/1985 | Urresti | |
| 6,059,165 | A | 5/2000 | Deng | |
| 2008/0011808 | A1 | 1/2008 | Melgaard et al. | |

FOREIGN PATENT DOCUMENTS

| | | |
|---|---|---|
| DE | 31 39 995 | 4/1983 |
| DE | 42 22 003 | 1/1994 |
| GB | 2 171 043 | 8/1986 |

OTHER PUBLICATIONS

International Search Report.
German Search Report dated Mar. 2, 2009 with English translation of relevant parts.

* cited by examiner

*Primary Examiner* — Brian D Nash
*Assistant Examiner* — Michelle Lopez
(74) *Attorney, Agent, or Firm* — Collard & Roe, P.C.

(57) ABSTRACT

A stapler has an anvil leg that supports an anvil plate in the front region, a staple magazine which can be swivelled to a limited degree about a transverse pin on a bearing block in the rear region of the anvil leg, and a driver leg which can be swivelled to a limited degree relative to the staple magazine and the anvil leg about the transverse pin. The driver leg supports a driver for guiding the staples through a gap at the front end of the staple magazine. The stapler has at least one guiding element which is arranged between the anvil plate and the bearing block. The guiding element longitudinally extends between the anvil leg and the staple magazine, is fixedly connected to the anvil leg, and is guided in a longitudinally movable manner within a guiding opening in a bottom wall of the staple magazine.

9 Claims, 2 Drawing Sheets

Figure 1:
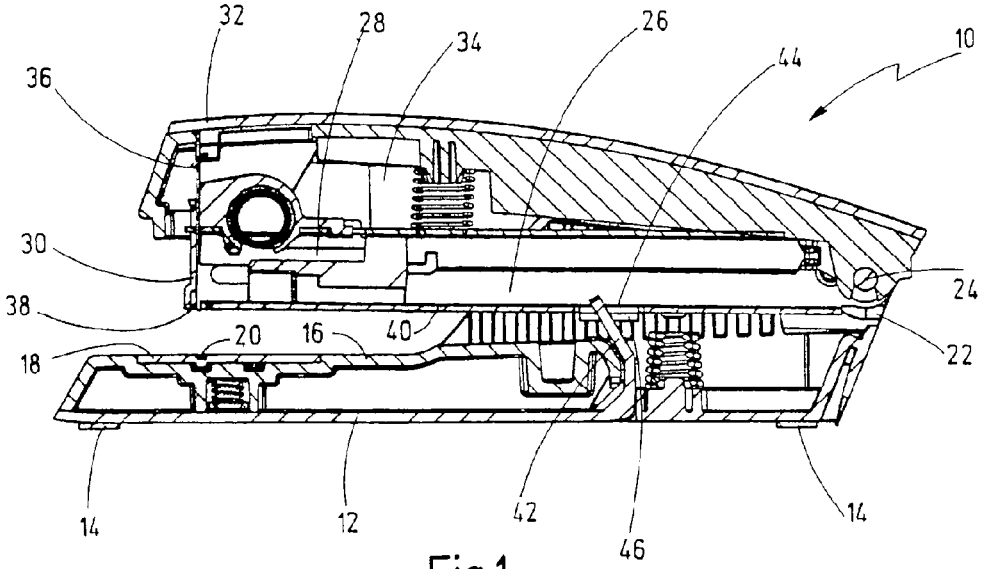

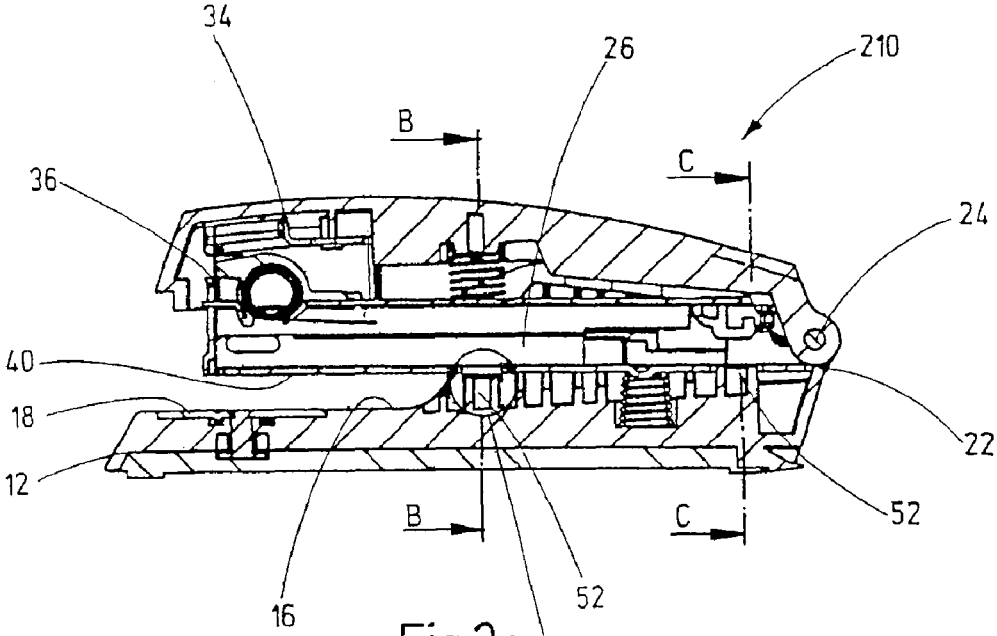
Fig.3a
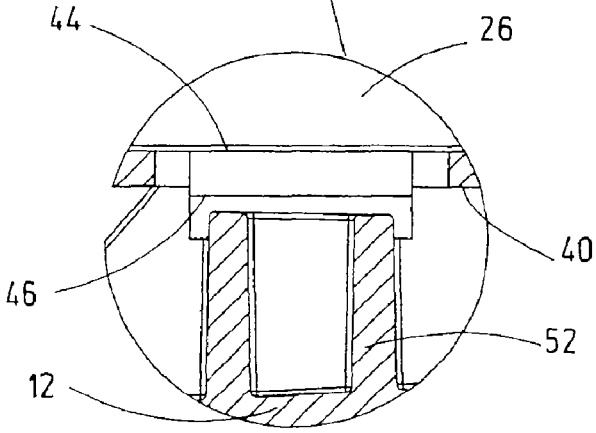
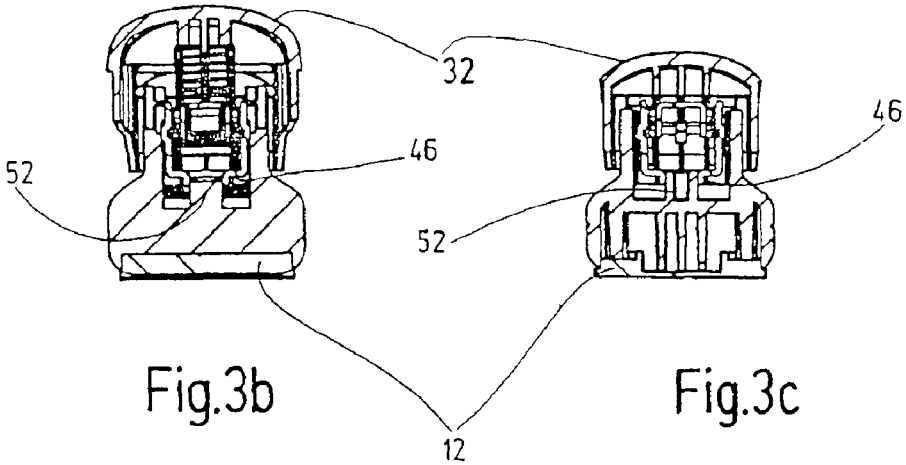
Fig.3b
Fig.3c

STAPLER

CROSS REFERENCE TO RELATED APPLICATIONS

This application is the National Stage of PCT/EP2009/052758 filed on Mar. 10, 2009, which claims priority under 35 U.S.C. §119 of German Application No. 10 2008 013 355.8 filed on Mar. 10, 2008, the disclosure of which is incorporated by reference. The international application under PCT article 21(2) was not published in English.

The invention relates to a stapler in accordance with the preamble of claim 1.

Known staplers of this type serve to staple together multiple sheets of paper, using a staple, whereby the staple is passed through the gap by pressing down the staple magazine and the driver arm, by means of the driver, penetrates the sheets, and is deformed on the anvil arm, by bending the free ends around. In order to always bring about deformation of the staple in defined manner, for example to always bend the two free ends toward one another, a deflection contour is formed into the anvil. When the driver is pressed down, the staple must then hit the deflection contour precisely, so that mis-stapling due to unwanted deformations of the staple is avoided. This is easily possible when the stapler stands on a level surface, for example a tabletop, and the driver arm is pressed vertically downward. However, if the stapler is held in the hand when stapling, transverse forces occur, which bring about lateral deflection of the driver arm or of the staple magazine relative to the anvil arm. This problem was already counteracted, in the case of known staplers, by means of a more stable structure of the transverse axis. It is also known to guide the staple magazine, in its rearward region, close to the transverse axis, in a lateral guide formed by means of side walls firmly connected with the anvil arm. Both measures reduce the risk of mis-stapling, but cannot prevent this when greater lateral forces occur.

It is therefore the task of the invention to further develop a stapler of the type stated initially, in such a manner that the risk of mis-stapling is reduced.

This task is accomplished, according to the invention, by means of a stapler having the characteristics of claim 1. Advantageous further developments are the object of the dependent claims.

The invention is based on the idea of making available an additional, stable lateral guide for the staple magazine, which prevents lateral deflection when pressing down on the anvil arm, to a great extent. In that the at least one guide element is guided in a floor wall of the staple magazine that runs essentially horizontally, the lateral guide can absorb even greater lateral forces without noteworthy deformation. In contrast to this, in the case of the known lateral guides, the counter-force acts on a side wall of the staple magazine, which is significantly more easily deformed, when force is applied in a perpendicular direction, than the floor wall, when force is applied parallel to its surface. In order to improve the longitudinal guidance of the guide element in the guide opening, a circumferential edge part is disposed around this opening, in both embodiment variants, which part extends, at least in certain sections, part way in the longitudinal direction of the guide element. The guide element, which engages into the guide opening equipped with the edge part, can then be structured to be shorter, and therefore be disposed closer to the anvil plate, without colliding with the staple pusher. Placement close to the anvil plate is advantageous because it results in greater rigidity.

The at least one guide element can be, for example, a bolt anchored in the anvil arm. This is introduced into the anvil arm as an additional component. However, it is preferred that the at least one guide element is a sheet-metal part formed on in one piece on the anvil arm. The sheet-metal part is simply bent upward, so that no additional component is required. This simplifies the production of the stapler. In this connection, care is necessary to ensure that the guide element does not collide with the staples or with a staple pusher, which is accommodated in the staple magazine to press the staples against a stop plate at the front end of the staple magazine, with spring support, during introduction into the staple magazine. A collision with the staples is avoided in that the guide element has a width that is less than the distance between the free arms of the staples, so that it can dip in between the free arms. In order to avoid a collision with the staple pusher, it is preferred that the latter also has a U-shaped cross-section that is open toward the bottom, into which the guide element engages, without colliding with the staple pusher.

It is preferred that the edge part has two lateral edges that extend in the longitudinal direction of the staple magazine or of the anvil arm, the distance between which edges, relative to one another, essentially corresponds to the width of the guide element. The guide element is guided between the lateral edges with only little play, so that only small lateral deflections of the staple magazine relative to the anvil arm are possible. It is practical if the edge part has an introduction slant for the guide element. This takes the fact into account that precise lateral guidance is absolutely necessary only when the staple magazine is set down onto the paper to be stapled. The introduction slant facilitates introduction of the guide element into the guide opening, whereby the latter narrows, starting from the introduction slant.

A further improvement is achieved if not only one guide element is present, but rather at least two guide elements, preferably disposed one behind the other in a line that extends in the longitudinal direction of the anvil arm. Each of the guide elements then engages into a guide opening. In this connection, it is possible that all the guide elements are identical, but a combination of the embodiments described is also possible. In particular, the additional guide element can be firmly connected with the staple magazine, and can engage into a guide opening in a ceiling wall of the anvil arm.

Figure 2A:
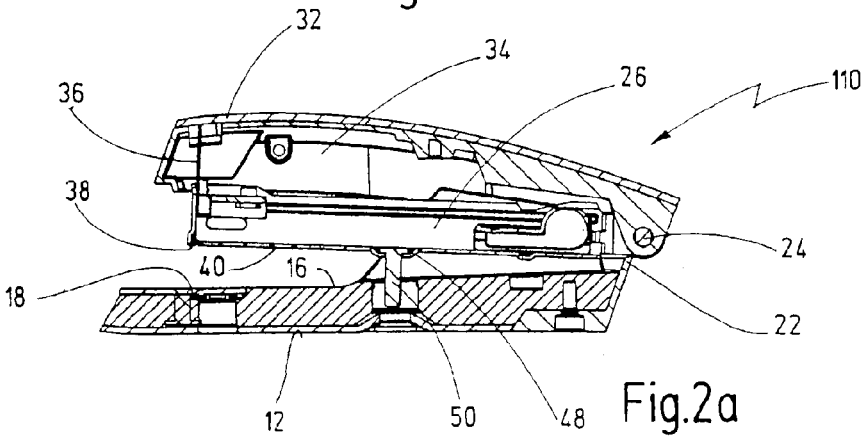

In the following, the invention will be explained in greater detail using two exemplary embodiments shown schematically in the drawing. This shows:

FIG. 1 a stapler according to a first exemplary embodiment in longitudinal section;

FIGS. 2*a, b* a stapler according to a second exemplary embodiment in longitudinal and transverse cross-section;

FIG. 3*a* a stapler according to a third exemplary embodiment in longitudinal section, with a detail representation; and FIGS. 3*b, c* the stapler according to FIG. 3*a* in two cross-sectional representations, along the lines B-B and C-C.

The stapler 10 according to the first exemplary embodiment (FIG. 1) has an anvil arm 12, which has rubber feet 14 on its underside, on which it can be set onto a tabletop. In the front region, an anvil plate 18 is inserted into a ceiling wall 16 of the anvil arm 12, which plate has a deflection contour 20 for deforming the staples that are pressed down onto the anvil plate 18. In the rear region of the anvil arm 12, a bearing block 22 is disposed, in which a transverse axis 24 is mounted, so as to rotate. In the bearing block 22, a staple magazine 26 that can be pivoted, in limited manner about the transverse axis 24 is mounted, in which magazine the staples are accommodated and which magazine has a spring-supported staple pusher 28 for pressing the staples against a front-side contact plate 30. A driver arm 34 that is covered by a handle 32 made of plastic is also mounted in the bearing block 22 and can be pivoted about the transverse axis 24, relative to the anvil arm 12 and the staple magazine 26, in limited manner. In the front region, the driver arm 34 has a driver 36 that presses the frontmost staple that is accommodated in the staple magazine 26 through a slot 38 in the floor wall 40 of the staple magazine 26, onto the anvil plate 18, when the handle 32 is pressed down.

Between the bearing block 22 and the anvil plate 18, a guide element in the form of a sheet-metal part 42 formed on in one piece with the anvil arm 12, stands upward. The guide element 42 projects into a guide opening 44 in the floor wall 40 of the staple magazine 26. The guide opening 44 has a clearly greater expanse in the longitudinal direction of the staple magazine 26 than the guide element 42. Its width, measured parallel to the transverse axis 24, however, is only very slightly greater than the width of the guide element 42, so that the latter practically rests against two lateral edges 46 that run at a distance from one another. The lateral edges 46 are part of an edge part 48 that runs part way in the longitudinal direction of the guide element 42 and around the guide opening 44. The distance between them increases downward, so that an introduction slant for the guide element 42 is formed.

Figure 2B:
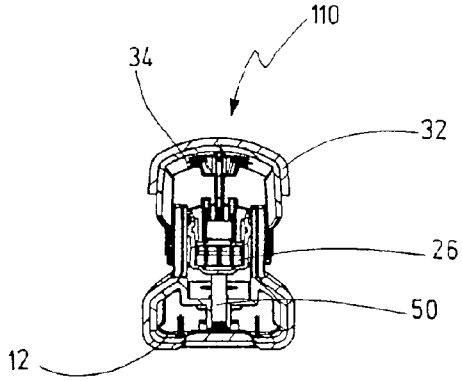

The stapler 110 according to the second exemplary embodiment (FIGS. 2*a*, 2*b*) essentially corresponds to the stapler 10 described above, so that the same components are provided with the same reference symbols. The most important difference from the stapler 10 according to the first exemplary embodiment consists in that a bolt 50 is anchored in the anvil arm 12 as a guide element. The bolt 50 is inserted into the anvil arm 12 as a separate component. The guide opening 44 is bordered by sheet-metal sections that form the edge part 48 and are bent down from the floor wall 40 of the staple magazine 26.

The stapler 210 according to the third exemplary embodiment (FIGS. 3*a*, 3*b*, 3*c*) also makes use of the same functional principle and corresponds, to a great extent, to the staplers 10, 110 described above. For this reason, the same components are again provided with the same reference symbols. According to the third exemplary embodiment, the stapler has two guide elements 52 that are disposed at different distances from the bearing block 22. A first guide element 52 is firmly connected with the anvil arm 12 close to the bearing block 22; another guide element 52 is disposed closer to the anvil plate 18. Both guide elements 52 are formed onto the anvil arm 12 in one piece, and have the shape of a hollow cylinder. They are disposed on a longitudinal center axis of the anvil arm 12. Each of the guide elements 52 engages into a guide opening 44 in the floor wall 40 of the staple magazine 26 and is guided by means of lateral edges 46 on the guide opening 44, which edges stand downward. By means of the use of two guide elements 52, guidance of the staple magazine 26 and of the driver arm 34 that is independent of other components, to a great extent, is obtained, whereby the flow of force of the forces that act laterally on the staple magazine 26 is short-circuited within the floor wall 40.

It is understood, of course, that in the manner of kinematic reversal, the guide elements 42, 50, 52 can just as well be firmly connected with the staple magazine 26 and guided into guide openings in the ceiling wall 16 of the anvil arm 12.

In summary, the following should be stated: The invention relates to a stapler 10, 110 having an anvil arm 12 that carries an anvil plate 18 in its front region, having a staple magazine 26 that can be pivoted, in limited manner, on a bearing block 22 in the rear region of the anvil arm 12, about a transverse axis 24, and having a driver arm 34 that can be pivoted, in limited manner, about the transverse axis 24, relative to the staple magazine 26 and the anvil arm 12, and carries a driver 36 for passing the staples through a slot 38 at the front end of the staple magazine 26. According to the invention, the stapler 10, 110 has at least one guide element 42, 50, 52 disposed between the anvil plate 18 and the bearing block 22, which element extends, in its longitudinal direction, between the anvil arm 12 and the staple magazine 26, and is firmly connected with the anvil arm 12 and guided in a guide opening 44 in a floor wall of the staple magazine 26, in longitudinally displaceable manner.

The invention claimed is:

1. A stapler comprising:

an anvil arm that carries an anvil plate in a front region thereof;

a staple magazine is adapted to be pivoted, in limited manner, on a bearing block in a rear region of the anvil arm, about a transverse axis;

a driver arm that is adapted to be pivoted, in limited manner, about the transverse axis, relative to the staple magazine and the anvil arm, said driver arm carrying a driver for passing staples through a slot at a front end of the staple magazine; and at least one guide element disposed between the anvil plate and the bearing blocks, said guide element extending, in its longitudinal direction, between the anvil arm and the staple magazine, and being firmly connected with the anvil arm and being guided in a guide opening in a floor wall of the staple magazine, in a longitudinally displaceable manner, wherein a circumferential edge part is disposed around the guide opening, said edge part extending at least part way in the longitudinal direction of the guide element, and wherein said edge part has an introduction slant for said guide element.

2. The stapler according to claim 1, wherein the at least one guide element is a bolt anchored in the anvil arm.

3. The stapler according to claim 1, wherein the at least one guide element is a sheet-metal part formed onto the anvil arm in one piece.

4. The stapler according claim 1, wherein the at least one guide element has a width, transverse to the longitudinal direction of the anvil arm, that is smaller than a distance between arms of the staples.

5. The stapler according to claim 1, wherein the staple magazine has a spring-supported staple pusher for pressing the staples against a contact plate at its front end, with a U-shaped cross-section that is open downward.

6. The stapler according to claim 5, wherein the at least one guide element has a width, transverse to the longitudinal direction of the anvil arm, which is smaller than a distance between U-arms of the staple pusher.

7. The stapler according to claim 1, wherein the edge part has two lateral edges that extend in the longitudinal direction of the staple magazine or of the anvil arm, a distance between which, relative to one another, essentially corresponds to a width of the guide element.

8. A stapler comprising:

an anvil arm that carries an anvil plate in a front region thereof;

a staple magazine is adapted to be pivoted, in limited manner, on a bearing block in a rear region of the anvil arm, about a transverse axis;

a driver arm that is adapted to be pivoted, in limited manner, about the transverse axis, relative to the staple magazine and the anvil arm, said driver arm carrying a driver for passing staples through a slot at a front end of the staple magazine; and at least two guide elements disposed between the anvil plate and the bearing blocks, each of said guide elements extending, in a longitudinal direction, between the anvil arm and the staple magazine, and being firmly connected with the anvil arm and being guided in a guide opening in a floor wall of the staple magazine, in a longitudinally displaceable manner.

9. The stapler according to claim 8, wherein the at least two guide elements are disposed one behind the other in a line that extends in the longitudinal direction of the anvil arm.

* * * * *